US006679677B2

(12) United States Patent
Yamauchi

(10) Patent No.: US 6,679,677 B2
(45) Date of Patent: Jan. 20, 2004

(54) VACUUM PUMP

(75) Inventor: Akira Yamauchi, Chiba (JP)

(73) Assignee: Seiko Instruments Inc., Chiba (JP)

( * ) Notice: Subject to any disclaimer, the term of this patent is extended or adjusted under 35 U.S.C. 154(b) by 33 days.

(21) Appl. No.: 10/061,130

(22) Filed: Jan. 31, 2002

(65) Prior Publication Data

US 2002/0108569 A1 Aug. 15, 2002

(30) Foreign Application Priority Data

Feb. 1, 2001 (JP) ..... 2001-024998

(51) Int. Cl.[7] ..... F04D 19/04

(52) U.S. Cl. ..... 415/90; 415/176; 415/177; 415/178; 417/423.4

(58) Field of Search ..... 415/90, 143, 175–178; 417/423.4, 904; 62/55.5

(56) References Cited

U.S. PATENT DOCUMENTS 4,873,833 A * 10/1989 Pfeiffer et al. ..... 62/55.5
4,926,648 A * 5/1990 Okumura et al. ..... 415/90
5,062,271 A * 11/1991 Okumura et al. ..... 415/90
5,350,275 A 9/1994 Ishimaru
5,548,964 A * 8/1996 Jinbo et al. ..... 62/55.5
5,577,883 A * 11/1996 Schutz et al. ..... 415/90
5,904,469 A * 5/1999 Cerruti ..... 415/90
5,938,406 A 8/1999 Cerruti
6,309,184 B1 * 10/2001 Moraja et al. ..... 62/55.5

FOREIGN PATENT DOCUMENTS

EP 0397051 11/1990
EP 0451708 10/1991

* cited by examiner

*Primary Examiner*—Christopher Verdier
(74) *Attorney, Agent, or Firm*—Adams & Wilks

(57) ABSTRACT

A vacuum pump has a casing having an inlet port and an outlet port, a flange integral with the casing and having a peripheral inner surface defining the inlet port and an end surface for connection to a container to be evacuated, and exhaust means for drawing in a gas through the inlet port and discharging the gas through the outlet port. A coating of material having low heat conductivity is disposed on the end surface of the flange.

20 Claims, 6 Drawing Sheets

VACUUM PUMP

BACKGROUND OF THE INVENTION

1. Field of the Invention

The present invention relates generally to vacuum pumps and, more specifically, to a turbo-molecular pump used to discharge process gas of a semiconductor manufacturing apparatus.

2. Description of the Related Art

As a result of the rapid progress in techniques for manufacturing semiconductors for an integrated circuit or the like and the demand for higher production amounts thereof, there is an increasing demand for a vacuum pump for discharging process gas from the chamber of a semiconductor manufacturing apparatus.

Generally speaking, as such a vacuum pump, a turbo-molecular pump in which the exhaust amount per unit time is large and which makes it possible to attain a high vacuum is used.

The exhaust system for discharging gas from the chamber of a semiconductor manufacturing apparatus is formed by arranging piping directly below the chamber to connect a conductance valve, and connecting a turbo-molecular pump to the conductance valve. The conductance valve is a valve for adjusting the chamber pressure.

By thus arranging the turbo-molecular valve in close vicinity to the chamber, the piping from the chamber to the turbo-molecular pump is shortened, whereby the reduction in conductance (easiness with which exhaust gas is conveyed) due to the piping is restrained.

In some cases, the turbo-molecular pump is directly connected to the chamber of the semiconductor manufacturing apparatus, without providing any conductance valve therebetween.

In the chamber of the semiconductor manufacturing apparatus, operations such as application of high-temperature process gas in the form of plasma to a semiconductor substrate and etching thereon are performed.

Such process gas is discharged by the turbo-molecular pump through the conductance valve, without being sufficiently cooled.

Thus, heat is imparted to the piping connected to the chamber and the conductance valve, and this heat is transmitted to the turbo-molecular pump.

In some cases, to enhance the reactivity of the process gas, the chamber itself is heated. Further, nowadays, in some cases, to prevent generation of deposit of the product, the conductance valve is heated.

As a result of heat conduction due to these factors, the temperature of the flange portion formed in the inlet of the turbo-molecular pump can exceed 60° C.

Inside a turbo-molecular pump, a rotor having a large number of radially arranged rotor blades rotates at a high speed of approximately several tens of thousand rpm.

The rotor blades are formed by an aluminum alloy or the like, which is superior in mechanical strength and light-weight.

However, the permissible temperature of the rotor blades is relatively low, ranging, for example, from 120° C. to 150° C. When the turbo-molecular pump is used for a long period of time at a temperature higher than this permissible temperature, the rotor blades undergo creep deformation due to the centrifugal force caused by high-speed rotation, resulting in a breakdown and a rather short period until parts replacement.

Further, when the flow rate of the exhaust gas is high, the temperature of the rotor blades, etc. rises due to collision of the molecules constituting the gas with the rotor blades and friction therebetween, so that, in some cases, to use the turbo-molecular pump at a temperature not higher than the permissible temperature, the amount of exhaust gas that can be continuously allowed to flow through the turbo-molecular pump (permissible flow rate) is limited.

It is accordingly an object of the present invention to provide a vacuum pump whose temperature rise is restrained, whereby deterioration in the vacuum pump due to temperature rise does not easily occur.

SUMMARY OF THE INVENTION

To achieve the above object, there is provided, in accordance with the present invention, a vacuum pump characterized by comprising a casing constituting an armor body, a gas inlet formed in the casing and connected to a container to be evacuated, a gas outlet formed in the casing, an exhaust means which sucks in a gas through the gas inlet and discharges the gas sucked in through the gas inlet through the gas outlet, and a bad heat conductor arranged in an end surface of the gas inlet (First Construction).

In the first construction, the gas inlet may be equipped with a flange, and the bad heat conductor may consist of a coating or plating formed on an opening surface of the flange (Second Construction).

Further, the bad heat conductor in the first construction may be a tubular member one end of which is connected to the gas inlet and the other end of which is connected to the container to be evacuated (Third Construction). The bad heat conductor in one of the first through third constructions may consist, for example, of a ceramic, resin, glass, or metal of low heat conductivity.

Further, in accordance with the present invention, there is provided a vacuum pump comprising a casing constituting an armor body, a gas inlet formed in the casing and connected to a container to be evacuated, a gas outlet formed in the casing, and an exhaust means which sucks in a gas through the gas inlet and discharges the gas sucked in through the gas inlet through the gas outlet, characterized in that at least a part of the casing portion from the gas inlet to the position where the exhaust means is accommodated is formed of a bad heat conductor over the entire circumference of the casing (Fourth Construction).

Further, to achieve the above object, there is provided, in accordance with the present invention, a vacuum pump characterized by comprising a casing constituting an armor body, a gas inlet formed in the casing and connected to a container to be evacuated, a gas outlet formed in the casing, an exhaust means which sucks in a gas through the gas inlet and discharges the gas sucked in through the gas inlet through the gas outlet, a good heat conductor arranged in the gas inlet, and a cooling means for cooling the good heat conductor (Fifth Construction). This good heat conductor may consist, for example, of aluminum or copper. The good heat conductor is, for example, a tubular member one end of which is connected to the gas inlet and the other end of which is connected to the container to be evacuated. The cooling means may consist of a cooling water supplying means for supplying cooling water to the periphery of the good heat conductor or a blowing means for supplying air flow to the periphery of the good conductor. When cooling the good conductor with air, it is possible to provide an air cooling fin in the periphery of the good conductor. The cooling means is not limited to the water cooling type and the air cooling type. It is also possible to use, for example, a device utilizing the Peltier effect, such as a Peltier element, and other methods.

Further, in the fifth construction, the good heat conductor is connected to the container to be evacuated through the bad heat conductor, whereby the quantity of heat transmitted from the gas inlet to the vacuum pump is reduced, and it is possible to prevent the container to be evacuated from being over-cooled by the cooling means (Sixth Construction).

In a vacuum pump according to one of the first through sixth constructions, the gas inlet is formed at one end of the casing, and the gas outlet is formed at the other end of the casing, and the exhaust means is a turbo-molecular pump including a rotor accommodated in the casing and rotatably supported, a plurality of rotor blades arranged radially in the periphery of the rotor, a driving means for driving the rotor to rotate it around the axis thereof, and a plurality of stator blades arranged from the inner peripheral surface of the casing toward the center of the casing (Seventh Construction).

BRIEF DESCRIPTION OF THE DRAWINGS

FIG. 3A shows the construction of a modification of the connecting surfaces of a flange. FIG. 3B shows the case in which the flange end surface of the turbo-molecular pump is plated.

DETAILED DESCRIPTION OF THE PREFERRED EMBODIMENT

First Embodiment

A first preferred embodiment of the present invention will now be described in detail with reference to FIGS. 1 through 4.

Figure 1:
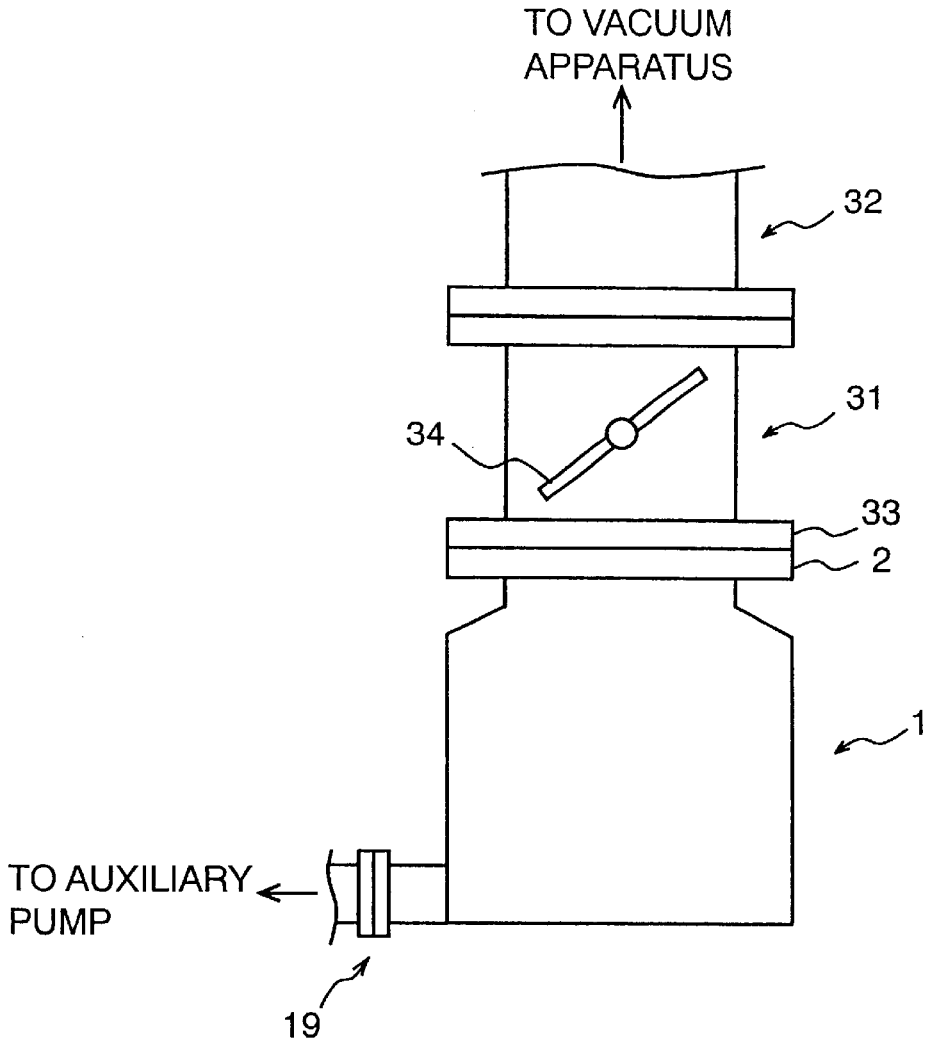
FIG. 1 is a schematic diagram showing the construction of an exhaust system according to a first embodiment.

FIG. 1 is a schematic diagram showing the construction of the exhaust system of this embodiment.

This exhaust system is composed of piping 32, a conductance valve 31, and a turbo-molecular pump 1.

One end of the piping 32 is connected to an opening of a vacuum device, such as the chamber of a semiconductor manufacturing apparatus, and a high temperature gas in the vacuum device flows through the piping 32. Formed at the other end of the piping 32 is a flange, to which a flange of the conductance valve 31 is connected.

The connection is effected by means of bolts or a clamper, with an O-ring or a metal gasket being placed between the flanges. Due to the action of the O-ring or the gasket, the connecting portion is hermetically sealed. It is also possible to effect the connection by welding.

The conductance valve 31 is a valve consisting, for example, of a butterfly valve. The butterfly valve includes a cylindrical valve case, in which is provided a disc-shaped valve element 34 having a diameter that is the same as the inner diameter of the flow passage, the valve element being rotated around a diametral shaft to thereby effect opening and closing. The valve element 34 is caused to rotate from outside the conductance valve 31 to adjust the sectional area of the flow passage. In the example shown in FIG. 1, the valve element 34 is arranged inside the conductance valve 31.

The conductance valve 31 is a valve for adjusting conductance (ease with which gas is allowed to flow). It is provided for the purpose of adjusting the degree to which the turbo-molecular pump 1 sucks in exhaust gas.

In this way, by opening and closing the conductance valve 31 for adjusting the degree to which the turbo-molecular pump 1 sucks in exhaust gas from the vacuum device, it is possible to adjust the pressure in the chamber.

The turbo molecular pump 1 sucks in exhaust gas through a gas inlet where a flange 2 is formed by the action of a large number of stator blades arranged on the inner peripheral surface of the casing and rotor blades arranged alternately with respect to the stator blades and adapted to rotate at high speed, and discharges the exhaust gas through a gas outlet 19. The construction of the turbo-molecular pump 1 will be described in detail below.

The turbo-molecular pump 1 is used as a main vacuum pump, and an auxiliary pump is connected to the gas outlet 19.

By means of the auxiliary pump, the pressure in the gas outlet 19 of the turbo-molecular pump 1 is reduced from the atmospheric state to a vacuum state, in which the turbo-molecular pump 1 functions in the normal fashion, whereby the performance of the turbo-molecular pump 1 is exerted, thereby making it possible to create a high-vacuum state inside the chamber.

Figure 2:
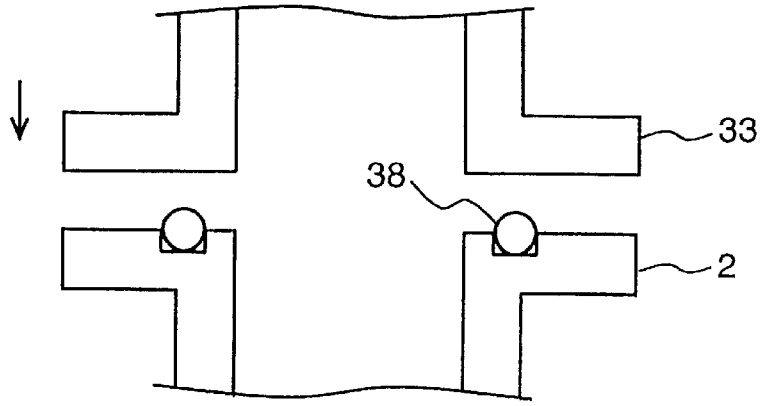
FIG. 2 is a sectional view showing the construction of the connecting surfaces of a flange of a turbo-molecular pump and a flange of a conductance valve.

FIG. 2 is a sectional view showing the construction of the connecting portion between the flange 2 of the turbo-molecular pump 1 and the flange 33 of the conductance valve 31.

In order that the drawing may not be too complicated, the opening edge line, which ought to be visible on the back side of the plane of the drawing, or the like is omitted. In FIG. 2, the state where the flange 33 is removed from the flange 2 is shown.

In the flanges 2 and 33, bolt holes (not shown) are concentrically formed. When they are connected to each other, the flange 33 is secured in position by bolts passed through the bolt holes in the direction indicated by the arrow in the drawing.

An annular groove is formed in the flange surface (contact surface) of the flange 2, and an O-ring 38 is fitted in this groove. The O-ring has a round sectional configuration and is formed of synthetic rubber. When the flanges 2 and 33 are firmly connected to each other by the bolts, the round section is crushed by the pressure from both flanges, and the O-ring comes into close contact with the flanges due to the resilient force of the synthetic rubber. It is also possible, as shown in FIG. 3A, to use center rings 39 and 40 to form a groove for arranging the O-ring, whereby the same effect as described above can be obtained.

While in the case in which the center rings 39 and 40 are not used it is necessary to form an annular groove for attaching an O-ring to the flange 2, the center rings 39 and 40 allow the flanges to be connected together, with the O-ring being placed between flat connection surfaces. The center ring 40 has an outwardly protruding sectional configuration, the step portions of the protrusion being fitted placed in the inner peripheries of the flanges 2 and 38.

Figure 3A:
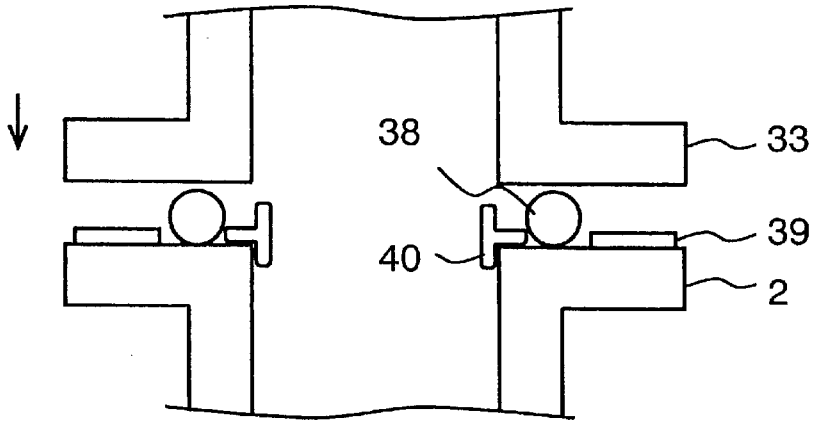
FIGS. 3A and 3B are sectional view showing the construction of the connecting surfaces of a flange of a turbo-molecular pump and a flange of a conductance valve.

In the case of FIG. 3A, in which center rings are used, it is possible to form the center rings of a bad heat conductor, such as a resin, whereby it is possible to prevent heat from being transmitted from the flange 33.

In contrast, in the case of FIG. 2, in which an O-ring groove is formed, there is no center ring, so that the flange 33 is directly connected to the flange 2. In this case, it is impossible to intercept the heat from the flange 33.

Figure 3B:
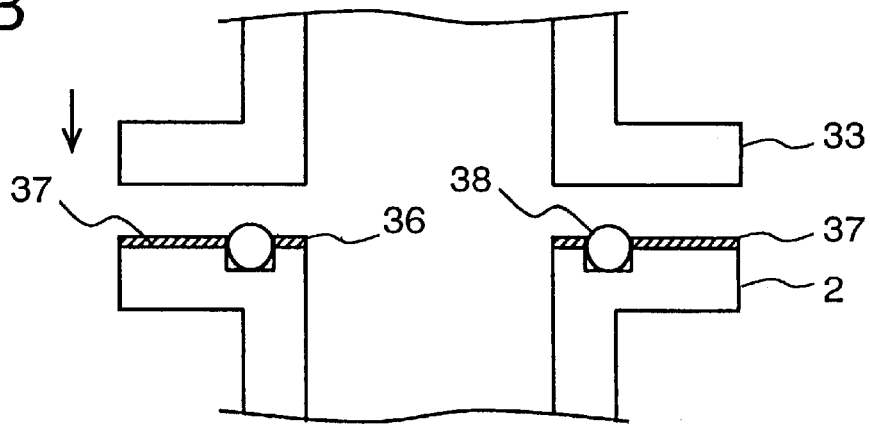

In view of this, as shown in FIG. 3B, coating or plating of a bad heat conductor is effected on the surface of the flange 2 to be connected with the flange 33. Examples of the bad heat conductor include a fluororesin and ceramic.

The coating (or plating) 36 is not always necessary; it is possible to achieve the desired effect with the coating (or plating) 37 alone. In the case in which the coating (or plating) 37 alone is used, it is possible to prevent problems, such as dissipation of gas from the coating (or plating) 36 to the exhaust system.

It is also possible to plate the end surface of the flange 2 or the flange 33 with a substance having a lower heat conductivity than the material of the flange 2 or the flange 33.

Further, while in this embodiment the O-ring 38 is used to seal the connecting portion between the flanges 2 and 33, this should not be construed restrictively. It is also possible to use a gasket instead of the O-ring 38.

Further, instead of bolts, a damper may be used for the connection of the flanges 2 and 33.

The construction of the turbo-molecular pump 1 will now be described.

Figure 4:
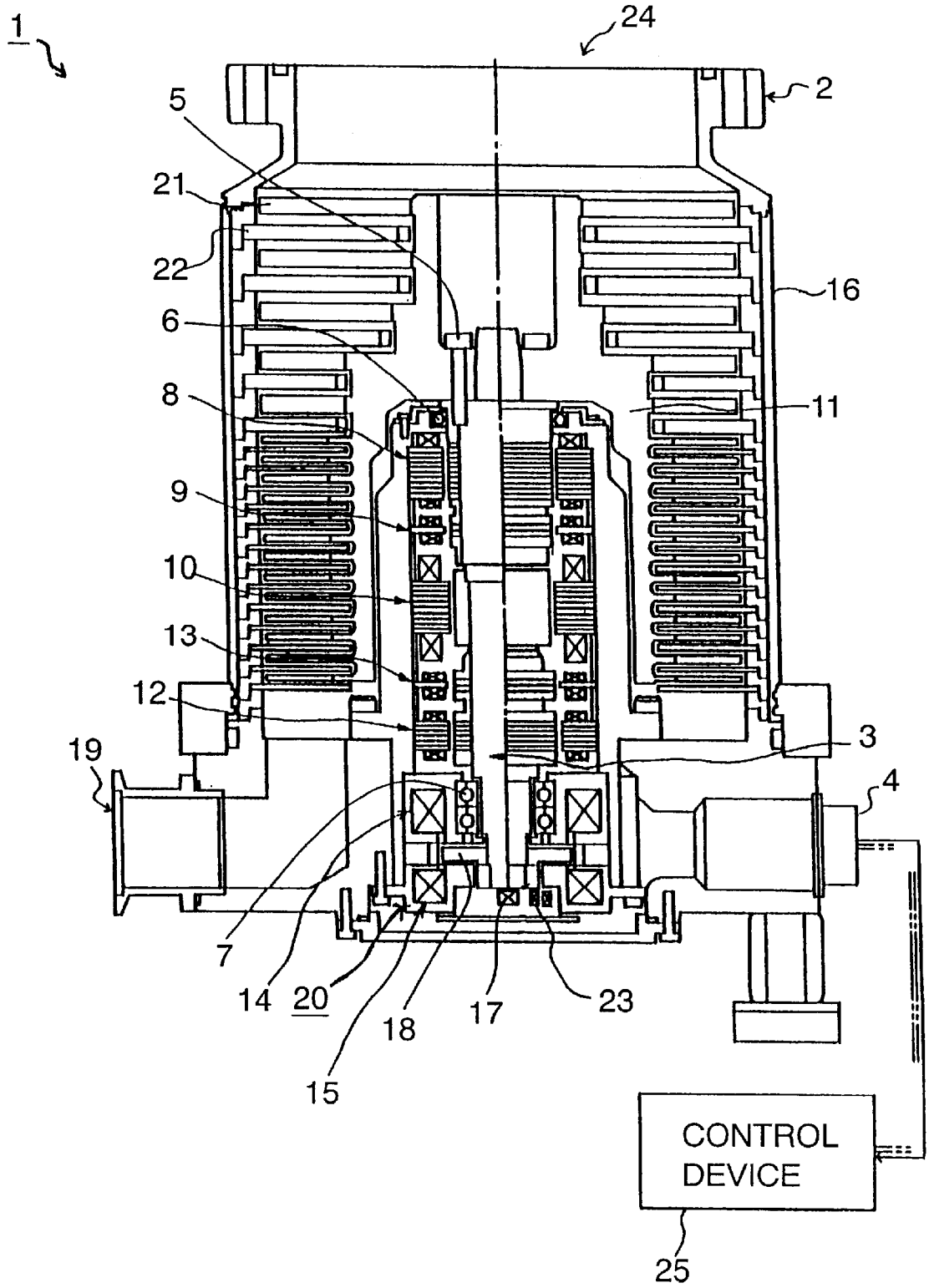
FIG. 4 is a sectional view of a turbo-molecular pump.

FIG. 4 is a sectional view of the turbo-molecular pump 1 taken along the direction of the rotor shaft.

A casing 16, which has a cylindrical configuration, constitutes the armor body of the turbo-molecular pump 1.

At the center of the casing 16, there is provided a rotor shaft 3.

In the upper portion, lower portion, and bottom portion of the rotor shaft 3 with respect to the plane of the drawing, there are provided magnetic bearing portions 8, 12, and 20, respectively. When the turbo-molecular pump 1 is operating, the rotor shaft 3 magnetically levitates in the radial direction thereof by means of the magnetic bearing portions 8 and 12 and is supported in a non-contact state; it also magnetically levitates in the thrust (axial) direction thereof and is supported in a non-contact state.

These magnetic bearing portions constitute a so-called 5-axis control type magnetic bearing, and the rotor shaft 3 and a rotor 11 firmly attached to the rotor shaft 3 have a degree of freedom in rotation around the axis of the rotor shaft 3.

In the magnetic bearing portion 8, four electromagnets are oppositely arranged around the rotor shaft 3 at intervals of 90 degrees. In the portion of the rotor shaft 3 opposed to these electromagnets, there is provided a target which consists of a ferromagnetic body formed through silicon steel lamination and which is attracted by the magnetic force of these electromagnets.

A displacement sensor 9 detects a radial displacement of the rotor 3. When it is detected by a displacement signal from the displacement sensor 9 that the rotor shaft 3 has been radially displaced from a predetermined position, a control device 25 adjusts the magnetic force of each electromagnet and operates so as to bring the rotor shaft 3 back to the predetermined position. The adjustment of the magnetic force of the electromagnets is effected through feedback control of exciting current of each electromagnet.

By this feedback control by the displacement sensor 9, the magnetic bearing portion 8, and the control device 25, the rotor shaft 3 magnetically levitates in the radial direction, with a predetermined clearance being maintained between it and the electromagnets in the magnetic bearing portion 8, and is supported in space in a non-contact state.

The construction and operation of the magnetic bearing portion 12 are the same as those of the magnetic bearing portion 8.

In the magnetic bearing portion 12, four electromagnets are arranged around the rotor shaft 3 at intervals of 90 degrees; by the attracting magnetic force of these electromagnets, the rotor shaft 3 is supported by the magnetic bearing portion 12 in a non-contact state with in the radial direction.

A displacement sensor 13 detects a displacement of the rotor shaft 3 in the radial direction.

When it receives a displacement signal from the displacement sensor 13 indicating a radial displacement of the rotor shaft 3, the control device 25 corrects this displacement and performs feedback control on the exciting current of the electromagnets so as to hold the rotor shaft 3 at the predetermined position. By this feedback control by the displacement sensor 13, the magnetic bearing portion 12, and the control device 25, the rotor shaft 3 magnetically levitates in the radial direction in the magnetic bearing portion 12, and is held in space in a non-contact state.

In this way, the rotor shaft 3 is radially held in two positions: the magnetic bearing portions 8 and 12, so that the rotor shaft 3 is held at a predetermined position in the radial direction.

The magnetic bearing portion 20 provided at the lower end of the rotor shaft 3 is composed of a metal disc 18, electromagnets 14 and 15, and a displacement sensor 17, and holds the rotor shaft 3 in the thrust direction.

The metal disc 18 is formed of a material having a high magnetic permeability. Examples of the material include iron, which is a ferromagnetic substance. The metal disc 18 is fixed at its center so as to be perpendicular to the rotor shaft 3. The electromagnets 14 and 15 are respectively provided above and below the metal disc 18. The electromagnet 14 magnetically attracts the metal disc 18 upwardly, and the electromagnet 15 magnetically attracts the metal disc 18 downwardly. The control device 25 appropriately adjusts the magnetic force applied to the metal disc 18 by the electromagnets 14 and 15, causing the rotor shaft 3 to magnetically levitate in the thrust direction to hold it in space in a non-contact state.

A displacement sensor 17 detects a displacement of the rotor shaft 3 in the thrust direction, and transmits a signal to the control device 25. The control device 25 monitors the displacement of the rotor shaft 3 in the thrust direction by a displacement detection signal received from the displacement sensor 13.

When the rotor shaft 3 moves in either way in the thrust direction to be displaced from a predetermined position, the control device 25 performs feedback control on the exciting current of the electromagnets 14 and 15 and adjusts the magnetic force so as to correct the displacement, restoring the rotor shaft 3 to the predetermined position. By this feedback control by the control device 25, the rotor shaft 3 magnetically levitates at a predetermined position in the thrust direction and is held at this position.

As described above, the rotor shaft 3 is held in the radial direction by the magnetic bearing portions 8 and 12, and is held in the thrust direction by the magnetic bearing portion 20, so that it only has a degree of freedom in rotation around the axis of the rotor shaft 3.

In the axial direction of the rotor shaft 3, a protective bearing 6 is provided above the magnetic bearing portion 8, and a protective bearing 7 is provided below the magnetic bearing portion 12.

The rotor shaft 3, which is caused to magnetically levitate and held in space in a non-contact state, can be significantly deviated from the holding position as a result, for example, of a run-out around the axis of the rotor shaft 3. In such a case, the protective bearings 6 and 7 prevent the rotor shaft 3 from coming into contact with the electromagnets of the magnetic bearing portions 8, 12, and 20, or the permanent magnet from coming into contact with the electromagnet in the motor portion 10.

When the rotor shaft 3 moves from a predetermined position by an amount not smaller than a certain amount, the rotor shaft 3 comes into contact with the protective bearings 6 and 7, thus physically restricting the movement of the rotor shaft 3.

In the rotor shaft 3, the motor portion 10 is provided between the magnetic bearing portions 8 and 12. As described below, the motor portion 10 constitutes a DC brushless motor.

In the motor portion 10, a permanent magnet is secured around the rotor shaft 3.

This permanent magnet is mounted, for example, such that N- and S-poles are arranged around the axis of the rotor shaft 3 by 180 degrees.

On the periphery of this permanent magnet, six electromagnets, for example, spaced apart from the permanent magnet by a predetermined clearance, are arranged symmetrically with respect to the axis of the rotor shaft 3 so as to be opposed to each other at intervals of 60 degrees.

Further, a speed sensor 23 is mounted to the lower end of the rotor shaft 3. By a detection signal from the speed sensor 23, the control portion 25 can detect the speed of the rotor shaft 3. Further, in the vicinity of the displacement sensor 13, there is mounted a sensor (not shown) for detecting the rotation phase of the rotor shaft 3, and the control device 25 can detect the position of the permanent magnet by using detection signals of this sensor and the speed sensor 23.

According to the position of the magnetic pole detected, the control device 25 successively switches the current of the electromagnet so that the rotation of the rotor shaft 3 may be maintained. That is, by switching the exciting current for the six electromagnets, the control device 25 generates a rotation magnetic field around the permanent magnet fixed to the rotor shaft 3, and rotates the rotor shaft 3 by causing the permanent magnet to follow this rotation magnetic field.

The rotor 11 is secured to the rotor shaft 3 by a bolt 5. As the rotor shaft 3 is driven by the motor portion 10 and rotates, the rotor 11 also rotates.

A plurality of rotor blades 21, inclined by a predetermined angle from the plane perpendicular to the axis of the rotor shaft 3, are radially mounted on the rotor 11. The rotor blades 21 are firmly attached to the rotor 11 and rotate at high speed with the rotor 11.

Further, stator blades 22 are fixed to the casing 16 so as to extend toward the interior of the casing 16 and are arranged alternately with the rotor blades 21. The stator blades 22 are fixed to the casing 16 so as to be at a predetermined angle from the plane perpendicular to the axis of the rotor shaft 3.

When the rotor 11 and the rotor shaft 3 are rotated by the motor portion 10, a gas is sucked in through a gas inlet 24 by the action of the rotor blades 21 and the stator blades 22, and is discharged through a gas outlet 19.

A flange 2 is formed on the periphery of the gas inlet 24, making it possible to connect the turbo-molecular pump 1 to be connected to the vacuum vessel of a semiconductor manufacturing apparatus or the like.

The control device 25 is connected to a connector 4 of the turbo-molecular pump 1, controlling the magnetic bearing portions 8, 12, and 20 and the motor portion 10.

The exhaust system constructed as described above operates as follows.

When turbo-molecular pump 1 operates, the rotor 11 levitates to a predetermined position by the magnetic bearing portions 8, 12, and 20, while being controlled by the control device 25. Then, the rotor shaft 3 is driven by the motor portion 10, and rotates around its axis, thereby causing the rotor 11 to rotate.

This also causes the rotor blades 21 to rotate, and, by the action of the rotor blades 21 and the stator blades 22, the gas in the vacuum device is sucked in through the conductance valve 31 and the gas inlet 24 and discharged through the gas outlet 19. Further, the auxiliary pump is also operated.

When the vacuum degree in the vacuum device has become sufficiently high, a semiconductor manufacturing process is started. A high temperature process gas is introduced into the vacuum device. This gas is discharged by the turbo-molecular pump 1 through the piping 32, without being sufficiently cooled. The temperature of the piping 32 begins to gradually increase, and subsequently, the temperature of the conductance valve 31 also starts to increase. In some cases, the flange 33 of the conductance valve 31 attains a temperature of approximately 60° C. Due to the thermal insulation between the flange 33 and the flange 2 by the coating (or plating) 36, 37, the quantity of heat transmitted to the turbo-molecular pump 1 from the flange 33 is reduced.

In this embodiment, the heat transmitted to the turbo-molecular pump 1 through the exhaust system can be intercepted by the coating (or plating) 36, 37 provided on the connecting surface of the flange 2.

Thus, it is possible to suppress the increase in the temperature of the rotor blades 21, and it is possible to mitigate the deterioration in the rotor blades 21 and other components due to creep generated as a result of the increase in temperature.

Second Embodiment

Figure 5:
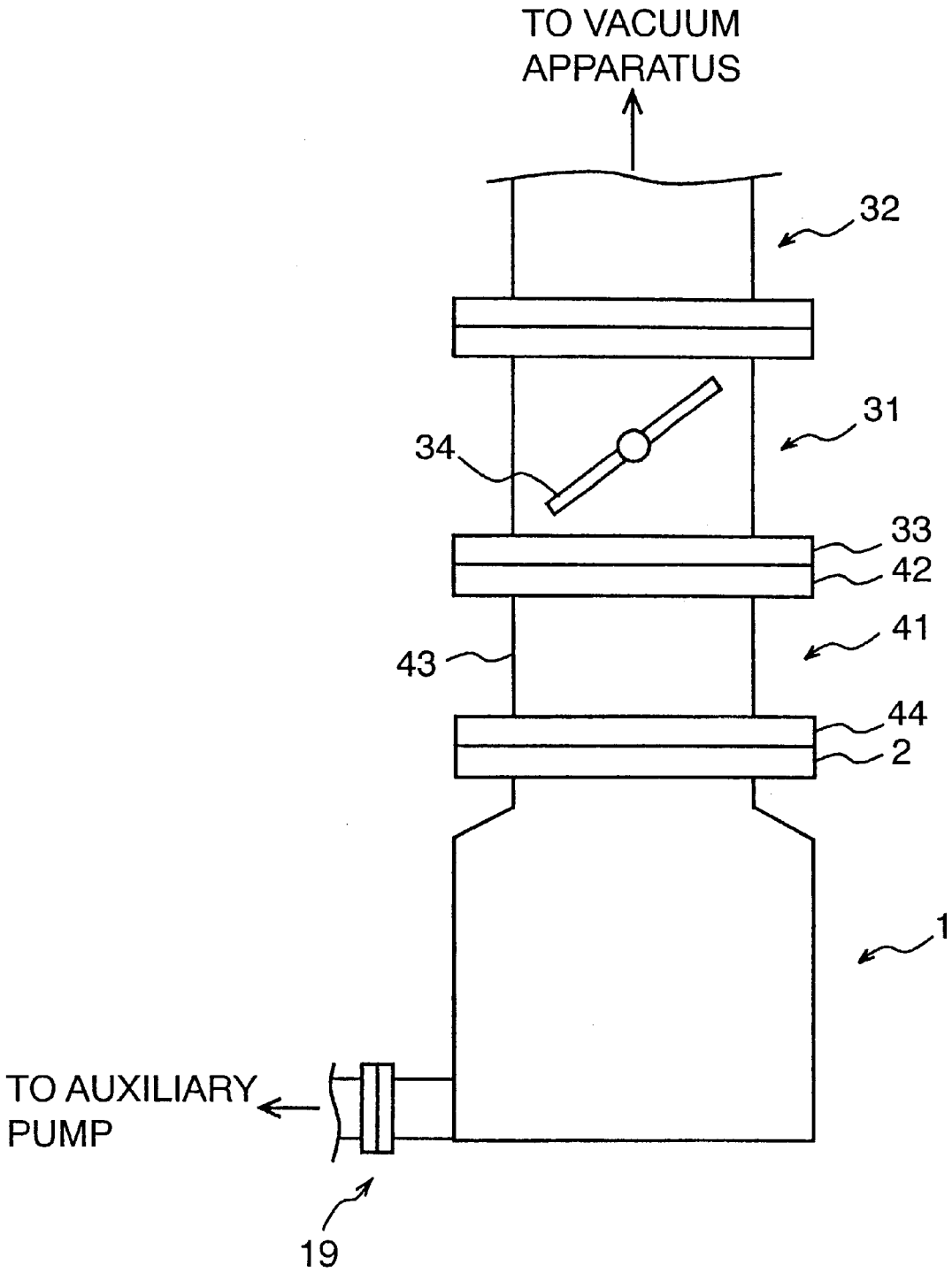
FIG. 5 is a schematic diagram showing the construction of an exhaust system according to a second embodiment.

A second embodiment will now be described with reference to FIG. 5. FIG. 5 is a schematic diagram showing the construction of an exhaust system according to the second embodiment.

The exhaust system comprises the piping 32, the conductance valve 31, a heat insulating portion 41, and the turbo-molecular pump 1.

One end of the piping 32 is connected, for example, to an opening of a vacuum device, such as the chamber of a semiconductor manufacturing apparatus, serving as an exhaust pipe for discharging high temperature gas in the vacuum device. The piping 32, the conductance valve 31, and the turbo-molecular pump 1 are the same as those of the first embodiment. While in the first embodiment the flange 33 is connected to the flange 2 through the center rings 39 and 40, the connection between the flange 33 and the flange 2 in the second embodiment is effected through the heat insulating portion 41.

The heat insulating portion 41 is composed of flanges 42 and 44 and a heat insulating pipe 43.

The flanges 42 and 43 have circular holes at their center, and bolt holes for connection with the flange 33 and the flange 2 are formed in concentric circles around the respective circular holes.

The insulating pipe 43 is connected by the circular hole portions of the flanges 42 and 44 by a means suitable for the material of these members, such as adhesive, welding, or brazing.

Usually, the conductance valve 31, the flange 33, the casing 16 of the turbo-molecular pump 1, and the flange 2 are formed of stainless steel, iron, aluminum or the like, whereas the heat insulating portion 41 is formed of a material whose heat conductivity is lower than that of these materials. Examples of such material include resin, ceramic, and a metal like chromium nickel (18Cr8Ni).

The flange 42 and the flange 33 are connected to each other by fastening bolts (not shown) passed through the bolt holes formed in the flanges 42 and 33. In the connecting portion between the flange 42 and the flange 33, there is placed an O-ring or a gasket for sealing.

Like the connection of the flanges 42 and 33, the connection of the flange 2 and the flange 44 is effected by bolt fastening, with an O-ring or a gasket being placed therebetween.

Instead of using the bolts, these connections can be effected by using a clamper.

In the second embodiment, when the turbo-molecular pump 1 operates to discharge the high temperature process gas used in the vacuum device, such as the chamber of a semiconductor manufacturing apparatus, the heat transmitted through the piping 32 and the conductance valve 31 is intercepted by the heat insulating portion 41, and the heat conduction to the turbo-molecular pump 1 can be mitigated. Further, in the second embodiment, the heat insulating pipe 43 has a length with respect to the heat transmitting direction, and is exposed to the atmosphere, so that heat radiation from the surface of the heat insulating pipe 43 to the periphery is effected while the heat is transmitted through the heat insulating pipe 43, thereby enhancing the heat insulating effect.

Thus, it is possible to restrain the temperature rise due to heat conduction from the gas inlet of the turbo-molecular pump 1, whereby it is possible to mitigate the deterioration in the turbo-molecular pump 1 which is due, for example, to the creep in the rotor blades as a result of temperature rise.

Further, it is also possible to form the conductance valve 31 itself of a bad conductor of heat and use it instead of the heat insulating member 41.

Third Embodiment

A third embodiment will now be described with reference to FIG. 6.

Figure 6:
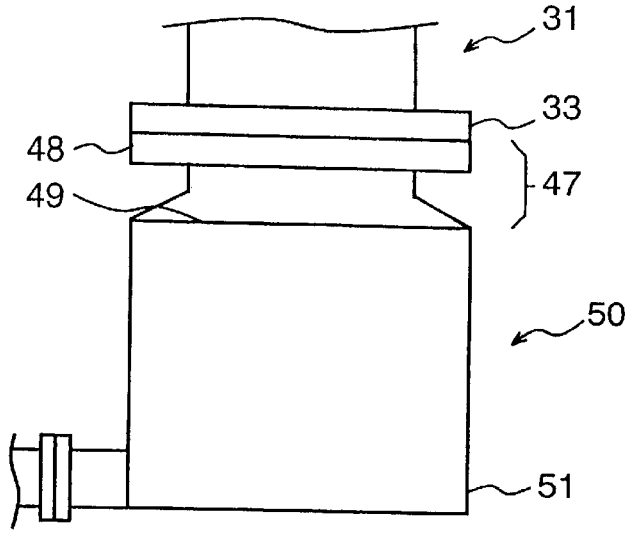
FIG. 6 is a diagram showing a turbo-molecular pump according to a third embodiment and a part of an exhaust system connected to the turbo-molecular pump.

FIG. 6 is a diagram showing a turbo-molecular pump 50 according to the third embodiment and a part of the exhaust system connected to the turbo-molecular pump 50.

In the exhaust system of the third embodiment, the turbo-molecular pump 1 of the first embodiment is replaced by the turbo-molecular pump 50.

The armor body of the turbo-molecular pump 50 is composed of a casing 51 and a gas inlet portion 47 forming a gas inlet.

The casing 51 consists of a substantially cylindrical member formed of stainless steel, iron, aluminum or the like, and contains a pump main body, such as a rotor.

The gas inlet portion 47 is formed of a heat insulating material and connected to the casing 51 by a connecting portion 49.

The construction of the turbo-molecular pump 50 is the same as that of the turbo-molecular pump 1 except that the gas inlet portion 47 is formed of a heat insulating material.

The gas inlet portion 47 is formed of a material whose thermal conductivity is lower than that of stainless steel, such as chromium nickel (18Cr8Ni).

A flange 48 formed on the gas inlet portion 47 has a circular hole at its center, and bolt holes are formed in the periphery of the circular hole. The flange 48 and the flange 33 are connected to each other by fastening bolts passed through the bolt holes, with an O-ring being placed therebetween. A connecting portion between the flange 48 and the flange 33 is sealed by the O-ring.

In the third embodiment, the heat transmitted through the conductance valve 31, etc. is intercepted by the gas inlet portion 47 to thereby mitigate the heat conduction to the turbo-molecular pipe 50.

Further, in the third embodiment, the material of the portion of the turbo-molecular pump 1 near the gas inlet 24 is replaced by a heat insulating material, so that the total length of the exhaust passage of the exhaust system is the same as that of the conventional exhaust system. Thus, in this embodiment, no deterioration in conductance occurs as a result of an increase in the length of the exhaust passage, and it is possible to reduce the quantity of heat transmitted to the turbo-molecular pump 1 through the piping of the exhaust system.

As described above, in this embodiment, it is possible to restrain flowing in of heat through the gas outlet of the turbo-molecular pump 50 while maintaining a satisfactory conductance.

Fourth Embodiment

Figure 7:
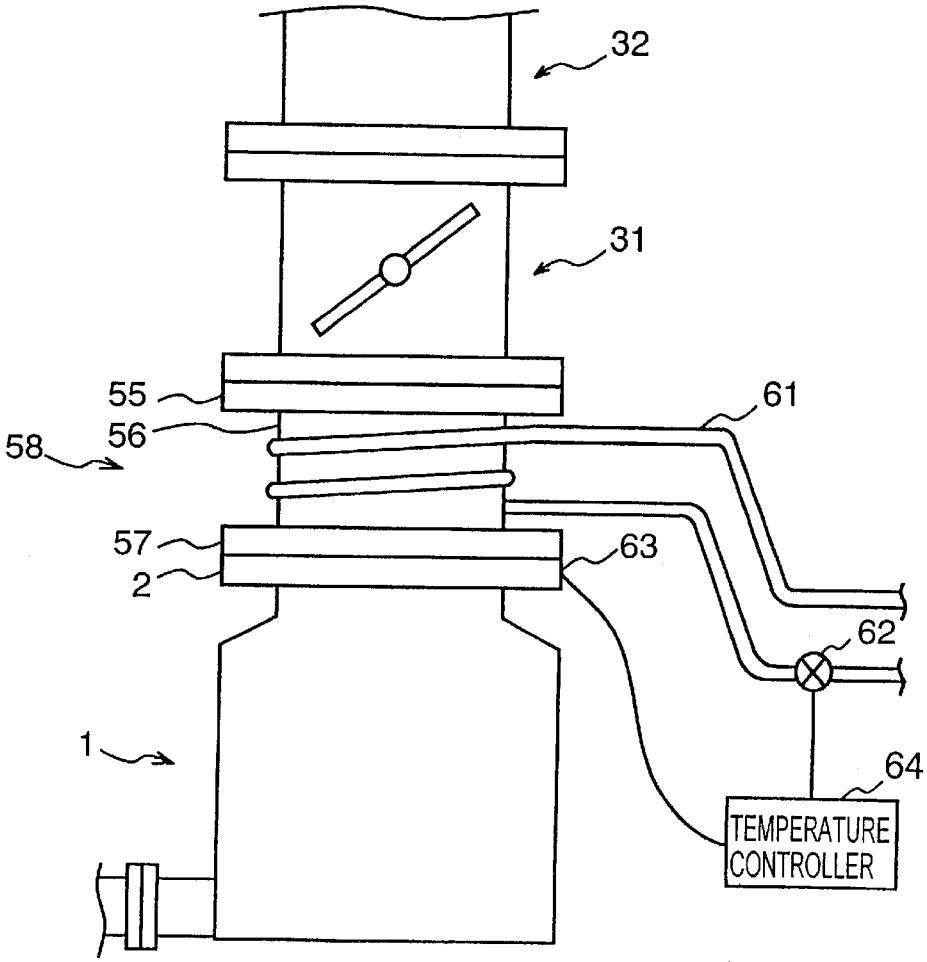
FIG. 7 is a schematic diagram showing the construction of an exhaust system according to a fourth embodiment.

A fourth embodiment will now be described with reference to FIG. 7. FIG. 7 is a diagram showing the construction of the exhaust system of the second embodiment.

This exhaust system is composed of the piping 32, the conductance valve 31, a cooling portion 58, and the turbo-molecular pump 1.

One end of the piping 32 is connected to the opening of a vacuum device, such as the chamber of a semiconductor manufacturing apparatus, serving as an exhaust duct for discharging high temperature gas in the vacuum device. The piping 32, the conductance valve 31, and the turbo-molecular pump 1 are the same as those of the first embodiment. The gas outlet of the turbo-molecular pump 1 is connected to an auxiliary pump (not shown).

The cooling portion 58 is composed of flanges 55 and 57, a heat conduction pipe 56, and a water cooling pipe 61.

The flanges 55 and 57 and the heat conduction pipe 56 are formed of a material having high heat conductivity, such as copper or aluminum. The flanges 55 and 57 have circular holes at their center, and bolt holes are formed in a concentric circle in the periphery of these circular holes.

The heat conduction pipe 56 is a piping for conveying exhaust gas, and flanges 55 and 57 are connected to its ends by welding or brazing.

The water cooling pipe 61 is spirally wound around the heat conduction pipe 56, making it possible to effect heat exchange between the heat conduction pipe 56 and cooling water flowing through the water cooling pipe 61.

Connected to the water cooling pipe 61 are an electromagnetic valve 62, a water supply pump (not shown), and a heat exchanger. The water supply pump supplies cooling water to the water cooling pipe 61, causing the water to circulate in the water cooling pipe 61. The heat exchanger effects heat exchange at the cooling portion 58; the cooling water whose temperature has risen is sent to the cooling portion 58 again to cool it for heat exchange.

The electromagnetic valve 62 is electrically connected to a temperature controller 64, and is opened and closed in response to an electric signal supplied from the temperature controller, thereby adjusting the flow of cooling water to the water cooling pipe 61.

Further, the temperature controller 64 is connected to a temperature sensor 63. The temperature sensor 63 is mounted to the flange 2 of the turbo-molecular pump 1, and the temperature controller 64 monitors the temperature of the flange 2. The temperature sensor 63 may consist, for example, of a thermocouple.

When the turbo-molecular pump 1 is operated to discharge, for example, high temperature process gas in a semiconductor manufacturing apparatus, heat is transmitted through the piping 32 and the conductance valve 31. Thus, when the electromagnetic valve 62 is closed to stop the circulation of cooling water in the water cooling pipe 61, the temperature of the cooling portion 58 rises, and heat is transmitted to the turbo-molecular pump 1. When the electromagnetic valve 62 is opened to circulate the cooling water in the water cooling pipe 61, the heat conduction pipe 56 is cooled by the cooling water, whereby it is possible to restrain heat conduction to the turbo-molecular pump 1.

Due to the above construction, the temperature controller 64 opens and closes the electromagnetic valve 62 such that the temperature of the flange 2 is within a predetermined range, for example, from T1 to T2 (T1<T2), thereby adjusting the heat exchange at the cooling portion 58.

Fifth Embodiment

While in the fourth embodiment the flanges 55 and 57 and the heat conduction pipe 56 are good conductors of heat, it is also possible for the flange 55 to be a bad conductor of heat and for the flange 57 and the heat conduction pipe 56 to be good conductors of heat.

It can happen that the product generated as a result of reaction with the process gas in the chamber adheres to the inner side of the piping when it touches the cooled pipe. The product thus adhering can, in some cases, flow reversely and adhere to the surface of the wafer in the chamber in the form of dust. The adhesion of such dust on the wafer surface results in the semiconductor manufacturing apparatus ceasing to operate in the normal manner. For example, it becomes impossible to form patterns correctly on the wafer, resulting in a reduction in yield.

In view of this, the conductance valve 31 and the piping 32 are thermally insulated by the flange 55 formed of a bad conductor of heat so that they may not be excessively cooled, and the heat conduction pipe 56 and the flange 57 formed of good conductors of heat are cooled, whereby it is possible to efficiently cool the flange 2 of the turbo-molecular pump 1 connected to the flange 57.

It is also possible to perform temperature control in the same manner as in the fourth embodiment.

Figure 8:
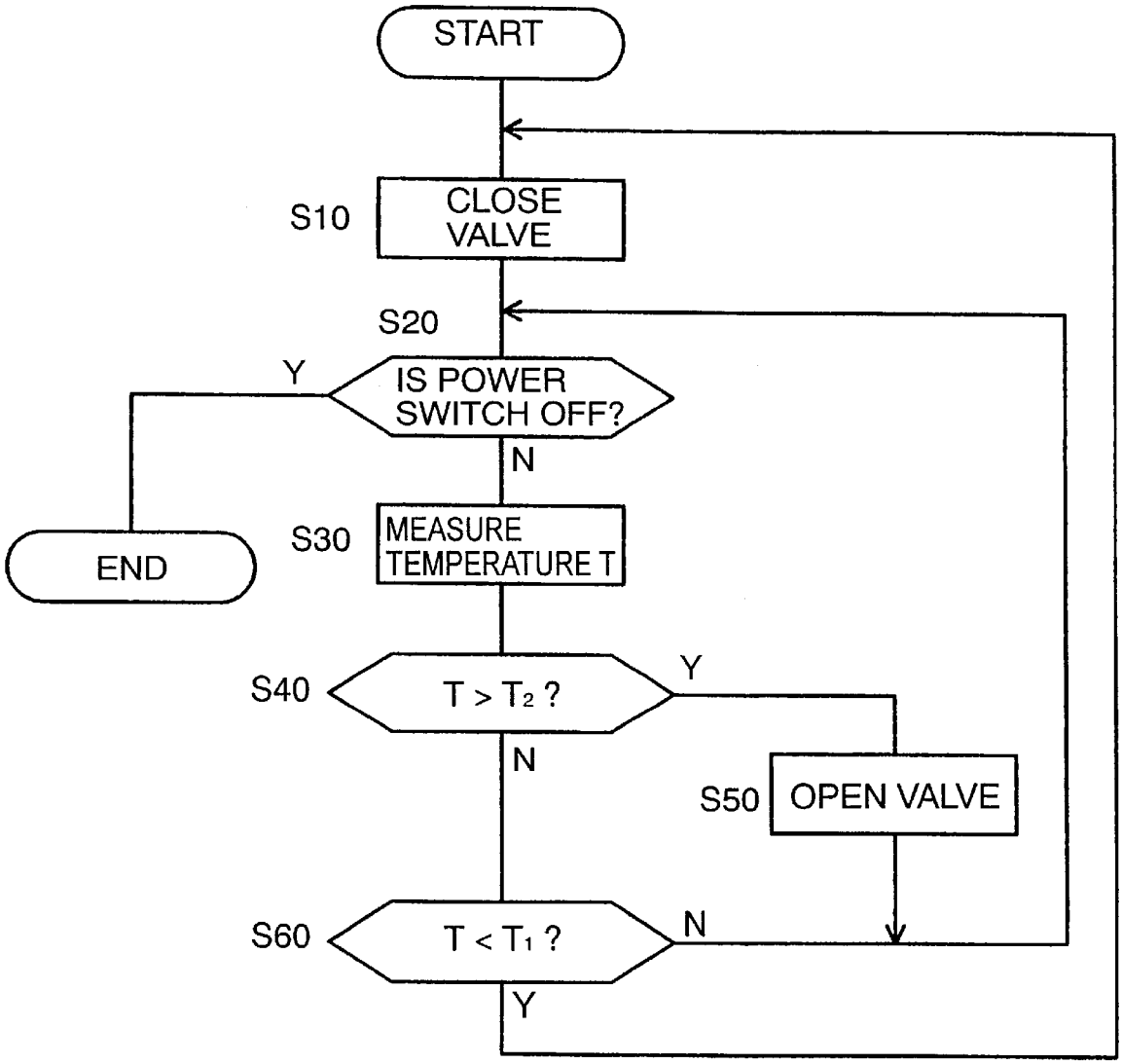
FIG. 8 is a flowchart illustrating the operation of a temperature controller.

FIG. 8 is a flowchart for illustrating the operation of the temperature controller 64.

It is to be assumed that the water supply pump and the heat exchanger connected to the water cooling pipe 61 are operating, and that heat is being transmitted through the piping 32 and the conductance valve 31 to flow into the cooling portion 58.

Operation is started when the power switch of the temperature controller 64 is turned on. First, the electromagnetic valve 62 is closed (step 10). As a result, the cooling water in the water cooling pipe 61 does not circulate, and the cooling portion 58 transmits heat, resulting in an increase in the temperature of the flange 2.

Next, the temperature controller 64 checks to see whether the power switch is off or not (step 20). When the power switch is on (i.e., when the answer in step 20 no), the temperature T of the flange 2 is obtained from the voltage of the temperature sensor 63 (step 30).

Next, the temperature controller 64 compares the temperature T with a predetermined temperature T2 previously stored in a storage portion of the temperature controller 64. When T is higher than T2 (i.e., when the answer in step 40 is yes), the electromagnetic valve 62 is opened, and cooling water is caused to circulate in the water cooling pipe 61 (step 50). As a result, the heat transmitted from the conductance valve 31 is absorbed by the cooling portion 58, and the temperature of the flange 2 starts to be lowered.

Next, the procedure of the temperature controller 64 returns to step 20, and the loop from step 20 to step 50 is repeated until the power switch becomes off (the answer in step 20 is yes) or until T becomes lower than T2 (the answer in step 40 is no). All this while, the temperature of the flange 2 continues to be lowered.

When the temperature controller 64 determines in step 40 that T is lower than T2 (i.e., when the answer in step 40 is no), T is further compared with a predetermined temperature T1 previously stored in a storage portion of the temperature controller 64 (step 60). T1 is lower than T2.

When T is higher than T1 (i.e., when the answer in step 60 is no), the procedure of the temperature controller 64 returns to step 20, and then the operations from step 20 to step 60 are repeated unless the power switch becomes off (the answer in step 20 is yes), the electromagnetic valve 62 being maintained in the open state. That is, all this while, the temperature of the flange 2 continues to be lowered.

When the temperature T of the flange 2 becomes lower than T1 (i.e., when the answer in step 60 is yes), the procedure of the temperature controller 64 returns to step 10, and the electromagnetic valve 62 is closed. Then, the circulation of cooling water in the water cooling pipe 61 is stopped, and the temperature T of the flange 2 starts to rise. After this, the temperature controller 64 repeats the loop consisting of steps 10, 20, 30, 40, and 60 until the power switch becomes off (the answer in step 20 is yes) or until T becomes higher than T2, maintaining the electromagnetic valve 62 in the closed state. That is, while this loop is being executed, the temperature of the flange 2 rises.

The temperature controller 64 repeats the above operation until the power switch becomes off (the answer in step 20 is yes), and the temperature of the flange 2 is repeatedly raised and lowered between T1 and T2.

For example, when T1 is 40[° C.] and T2 is 50[° C.], the temperature of flange 2 is controlled so as to be between 40[° C.] and 50[° C.].

In the fourth embodiment, the quantity of heat transmitted through the piping 32 and the conductance valve 31 to flow into the turbo-molecular pump 1 can be controlled to an appropriate value, so that it is possible to prevent a deterioration in the rotor blades 21 due to abnormal temperature rise in the rotor blades 21 of the turbo-molecular pump 1 and precipitation of the product inside the turbo-molecular pump 1 due to excessive cooling of the turbo-molecular pump 1.

While in the fourth embodiment described above a water cooling system using cooling water is used as the means for cooling the cooling portion 58, this should not be construed restrictively. It is also possible to adopt an air cooling system using an air-cooling fan.

While in the first through fifth embodiments described above a turbo-molecular pump is used as the vacuum pump, this should not be construed restrictively. The present invention is also applicable, for example, to a case in which a vacuum pump, such as a rotary pump or an ion pump, is thermally insulated from a vacuum apparatus.

In accordance with the present invention, it is possible to restrain a temperature rise in a vacuum pump due to flowing of heat into the vacuum pump through piping, making it possible to provide a vacuum pump in which deterioration in parts as a result of temperature rise is minimized.

What is claimed is:

1. A vacuum pump comprising:

a casing having an inlet port and an outlet port;

a flange integral with the casing and having a peripheral inner surface defining the inlet port, the flange having an end surface for connection to a container to be evacuated;

a coating of material having low heat conductivity disposed on the end surface of the flange; and exhaust means for drawing in a gas through the inlet port and discharging the gas through the outlet port.

2. A vacuum pump according to claim 1; wherein the inlet port is disposed at a first end of the casing and the outlet port is disposed at a second end of the casing opposite the first end; and wherein the exhaust means comprises a turbo-molecular pump having a rotor mounted in the casing for undergoing rotation about a rotor axis, a plurality of rotor blades radially mounted in the periphery of the rotor, driving means for rotationally driving the rotor about the rotor axis, and a plurality of stator blades extending from an inner peripheral surface of the casing toward a center of the casing.

3. A vacuum pump comprising:

a casing having an interior space, an inlet port for introducing gas molecules into the interior space, and an outlet port for discharging the gas molecules from the interior space;

exhaust means disposed in the interior space of the casing for drawing in gas molecules through the inlet port and discharging the gas molecules through the outlet port; and a tubular member integrally connected to the casing between the inlet port and the exhaust means, the tubular member being made of one of a resin material, ceramic and glass.

4. A vacuum pump according to claim 3; wherein the inlet port is disposed at a first end of the casing and the outlet port is disposed at a second end of the casing opposite the first end; and wherein the exhaust means comprises a turbo-molecular pump having a rotor mounted in the casing for undergoing rotation about a rotor axis, a plurality of rotor blades radially mounted in the periphery of the rotor, driving means for rotationally driving the rotor about the rotor axis, and a plurality of stator blades extending from an inner peripheral surface of the casing toward a center of the casing.

5. A vacuum pump according to claim 3; wherein the tubular member is made of a resin material.

6. A vacuum pump according to claim 3; wherein the tubular member is made of ceramic.

7. A vacuum pump according to claim 3; wherein the tubular member is made of glass.

8. A vacuum pump comprising:

a casing having an inlet port and an outlet port;

exhaust means for drawing in a gas through the inlet port and discharging the gas through the gas outlet port;

a tubular member formed of a material having high heat conductivity and connected to the case at the gas inlet port;

cooling means for cooling the tubular member; and a connecting member formed of a material having low heat conductivity for connecting the tubular member to a container to be evacuated.

9. A vacuum pump according to claim 8; wherein the inlet port is disposed at a first end of the casing and the outlet port is disposed at a second end of the casing opposite the first end; and wherein the exhaust means comprises a turbo-molecular pump having a rotor mounted in the casing for undergoing rotation about a rotor axis, a plurality of rotor blades radially mounted in the periphery of the rotor, driving means for rotationally driving the rotor about the rotor axis, and a plurality of stator blades extending from an inner peripheral surface of the casing toward a center of the casing.

10. A vacuum pump according to claim 8; wherein the cooling means comprises a cooling pipe for circulating a low temperature gas or fluid to cool the tubular member.

11. A vacuum pump according to claim 8; wherein the cooling means comprises a cooling pipe for circulating cool water to cool the tubular member.

12. A vacuum pump comprising:

a casing having an inlet port;

a tubular member having opposite open ends one of which is connected to the casing at the inlet port;

discharge means disposed in the casing for discharging a high temperature gas through the tubular member so that a temperature of the tubular member is increased by the high temperature gas; and a coating of thermally insulating material disposed between the inlet port of the casing and the open end of the tubular member for reducing a quantity of heat transmitted from the tubular member to the discharge means.

13. A vacuum pump according to claim 12; wherein the discharge means comprises a turbomolecular pump.

14. A vacuum pump according to claim 13; wherein the turbomolecular pump comprises a rotor mounted in the casing for undergoing rotation, a plurality of rotor blades connected to the rotor for rotation therewith, driving means for rotationally driving the rotor, and a plurality of stator blades connected to an inner peripheral surface of the casing.

15. A vacuum pump according to claim 12; wherein the casing has a first connecting member at the inlet port thereof, the first connecting member having a connecting surface; and wherein the tubular member has a second connecting member at the open end thereof, the second connecting member having a connecting surface connected to the connecting surface of the first connecting member.

16. A vacuum pump according to claim 15; wherein the coating of thermally insulating material is disposed on one of the connecting surface of the first connecting member and the connecting surface of the second connecting member.

17. A vacuum pump according to claim 15; wherein the coating of thermally insulating material is disposed on at least a portion of the connecting surface of the first connecting member.

18. A vacuum pump according to claim 17; wherein the thermally insulating material has a lower heat conductivity than that of the second connecting member.

19. A vacuum pump according to claim 12; wherein the thermally insulating material comprises a fluororesin.

20. A vacuum pump according to claim 12; wherein the thermally insulating material comprises ceramic.

* * * * *